US012504208B2

(12) United States Patent
Ohki et al.

(10) Patent No.: US 12,504,208 B2
(45) Date of Patent: Dec. 23, 2025

(54) REFRIGERATOR

(71) Applicants: HAIER SMART HOME CO., LTD., Qingdao (CN); QINGDAO HAIER REFRIGERATOR CO., LTD., Qingdao (CN); AQUA CO., LTD., Tokyo (JP)

(72) Inventors: Tatsuya Ohki, Tokyo (JP); Yoshihiko Wada, Tokyo (JP); Takaya Tateno, Tokyo (JP)

(73) Assignees: HAIER SMART HOME CO., LTD., Qingdao (CN); QINGDAO HAIER REFRIGERATOR CO., LTD., Qingdao (CN); AQUA CO., LTD., Tokyo (JP)

( * ) Notice: Subject to any disclaimer, the term of this patent is extended or adjusted under 35 U.S.C. 154(b) by 135 days.

(21) Appl. No.: 18/270,195

(22) PCT Filed: Dec. 23, 2021

(86) PCT No.: PCT/CN2021/140884
§ 371 (c)(1),
(2) Date: Jun. 28, 2023

(87) PCT Pub. No.: WO2022/143415
PCT Pub. Date: Jul. 7, 2022

(65) Prior Publication Data

US 2024/0060694 A1 Feb. 22, 2024

(30) Foreign Application Priority Data

Dec. 28, 2020 (JP) ..... 2020-218937

(51) Int. Cl.
*F25B 41/20* (2021.01)
*F25B 13/00* (2006.01)

(52) U.S. Cl.
CPC ..... *F25B 41/20* (2021.01); *F25B 13/00* (2013.01)

(58) Field of Classification Search
CPC ..... F25D 21/002; F25D 21/04; F25D 21/004; F25D 21/12; F25D 11/04; F25D 17/045;
(Continued)

(56) References Cited

U.S. PATENT DOCUMENTS 3,992,895 A * 11/1976 Kramer ..... F25D 21/002 62/155
4,095,438 A * 6/1978 Kramer ..... F25B 47/022 62/278
(Continued)

FOREIGN PATENT DOCUMENTS

CN 101743449 A 6/2010
CN 102317724 A 1/2012
(Continued)

*Primary Examiner* — Jianying C Atkisson
*Assistant Examiner* — Meraj A Shaikh
(74) *Attorney, Agent, or Firm* — Cheng-Ju Chiang

(57) ABSTRACT

A refrigerator, comprising a cooling loop. The cooling loop has a first flow path in which a compressor, a condenser, a capillary tube, and an evaporator are sequentially connected for circulating a refrigerant. The cooling loop comprises: a hot gas bypass tube, configured to form a second flow path that enables the refrigerant compressed by the compressor to flow from the compressor to the evaporator; a three-way valve, provided in the first flow path between the compressor and the condenser and connected to the hot gas bypass tube; and a two-way valve, provided in the first flow path between the condenser and the capillary tube. The three-way valve can enable the refrigerant discharged from the compressor to flow to the condenser or the hot gas bypass tube, and the two-way valve can be switched off to cut off the flow of the refrigerant discharged from the condenser.

10 Claims, 4 Drawing Sheets

(58) Field of Classification Search
CPC ..... F25D 31/005; F25D 2500/04; F25D 2700/123; F25D 2700/122; F25B 2600/23; F25B 2600/01; F25B 2700/2117; F25B 2700/122; F25B 2700/123; F25B 2347/021; F25B 2500/19
See application file for complete search history.

(56) References Cited

U.S. PATENT DOCUMENTS

| | | | | | |
|---|---|---|---|---|---|
| 4,354,360 | A * | 10/1982 | Fiske | F25B 43/006 | 62/320 |
| 4,688,392 | A | 8/1987 | Fujimoto et al. | | |
| 2009/0000321 | A1* | 1/2009 | Hall | F25B 47/022 | 62/227 |
| 2009/0320504 | A1 | 12/2009 | Gupte | | |
| 2011/0271703 | A1* | 11/2011 | Park | F25B 47/022 | 62/441 |
| 2013/0098077 | A1* | 4/2013 | Bonet | F25D 21/08 | 62/82 |
| 2018/0347862 | A1* | 12/2018 | Wang | F25B 49/022 | |

FOREIGN PATENT DOCUMENTS

| | | | | |
|---|---|---|---|---|
| CN | 104613688 | A | | 5/2015 |
| CN | 104613688 | B | * | 1/2017 |
| CN | 108458534 | A | | 8/2018 |
| CN | 208765263 | U | | 4/2019 |
| CN | 109813017 | A | | 5/2019 |
| CN | 209246477 | U | | 8/2019 |
| JP | 6403907 | B2 | | 9/2018 |

* cited by examiner

REFRIGERATOR

CROSS REFERENCE TO RELATED APPLICATIONS

The present invention is a 35 U.S.C. § 371 National Phase conversion of International (PCT) Patent Application No. PCT/CN2021/140884, filed on Dec. 23, 2021, which claims benefit of Japanese Application No. 2020-218937, filed on Dec. 28, 2020, the disclosure of which is incorporated by reference herein. The PCT International Patent Application was filed and published in Chinese.

BACKGROUND OF THE INVENTION

Field of the Invention

The present invention relates to a refrigerator, and particularly to a refrigerator in which frost adhered to an evaporator is removed with hot gas.

Description of Related Art

Frost might be adhered to an evaporator as one of components of a cooling loop of a refrigerator because the surrounding steam is cooled, thereby reducing the cooling performance. To solve this problem, in a known manner of removing the frost with hot gas, a hot gas bypass tube connected to the upstream side of the evaporator is disposed downstream of a compressor as one of the components of the cooling loop, high-temperature gas being allowed to temporarily flow through the hot gas bypass tube to the evaporator, thereby heating the evaporator to defrost. In the defrosting manner with hot gas, if the amount of liquid returned by the refrigerant flowing through the hot gas bypass tube to the compressor increases, the reliability of the compressor will reduce. Therefore, for example, patent document 1 discloses an invention of reducing the amount of liquid returned to the compressor to improve the reliability of a refrigeration cycle device.

PRIOR ART DOCUMENTS

Patent Documents

[Patent Document 1]: JP Patent Application No. 2017-554766.

However, the invention disclosed in Patent Document 1 needs to include a complicated system to regulate the flow through the hot gas bypass tube, for example, needs to include a flow regulator, a refrigerant state detection unit, and a defrost control unit etc. The flow regulator is connected to the hot gas bypass tube and configured to regulate the flow of the refrigerant through the hot gas bypass tube. The refrigerant state detection unit detects a discharge overheat degree of the refrigerant discharged from the compressor and a suction pressure of the compressor. The defrost control unit usually closes the flow regulator upon cooling operation, and upon a defrosting action, enables the flow regulator to increase or decrease the flow of the refrigerant through the hot gas bypass tube according to the discharge overheat degree and the suction pressure detected by the refrigerant state detection unit.

In view of this, it is necessary to improve the conventional refrigerators to address the above problems.

BRIEF SUMMARY OF THE INVENTION

An object of the present invention is to provide a refrigerator capable of more easily reducing the flow of the refrigerant flowing through a hot gas bypass tube without complicating the system and avoiding a decrease in the defrosting capacity.

In order to achieve the above object, the present invention provides a refrigerator comprising: a cooling loop having a first flow path connected in order of a compressor, a condenser, a capillary tube, and an evaporator and configured to circulate a refrigerant, the compressor compressing the refrigerant sent from the evaporator, the condenser condensing the refrigerant sent from the compressor, the capillary tube expanding the refrigerant sent from the condenser, and the evaporator evaporating the refrigerant sent from the capillary tube, the cooling loop comprising: a hot gas bypass tube configured to form a second flow path in which the refrigerant compressed by the compressor flows from the compressor to the evaporator; a three-way valve provided in the first flow path between the compressor and the condenser and connected to the hot gas bypass tube; and a two-way valve provided in the first flow path between the condenser and the capillary tube, the three-way valve being capable of enabling the refrigerant discharged from the compressor to flow into the condenser or the hot gas bypass tube, the two-way valve being capable of shutting off the flow of the refrigerant discharged from the condenser by closing.

Thus, in a refrigerator in which the defrost of the evaporator is performed in the hot gas defrosting manner, the three-way valve is disposed downstream of the compressor and upstream of the condenser, and the two-way valve is disposed downstream of the condenser and upstream of the capillary tube. A hot gas defrosting pipe is provided that bypasses the refrigerant in a hot gas state from downstream of the compressor to upstream of the evaporator via the three-way valve. With such a configuration of the cooling loop, the flow path of the refrigerant can be changed. In addition, the flow of the refrigerant can be shut off. Therefore, it can be expected that the flow of the refrigerant flowing through the hot gas bypass tube can be easily reduced without including a complicated system to suppress the decrease in the defrosting capacity.

Furthermore, the refrigerator has a control device that switches the cooling loop to a conventional operation of cooling the evaporator and a defrosting action of defrosting the evaporator, the control device being capable of controlling the three-way valve to allow the fluid to flow to which one of the condenser and the hot gas bypass tube, and also being capable of controlling the opening and closing of the two-way valve, the control device being controlled in the following manner in case of switching from the conventional operation to the defrosting action: the three-way valve enables the refrigerant to flow to the condenser and closes the two-way valve, thereby discharging the refrigerant to the condenser through the compressor, and then the three-way valve enables the refrigerant to flow to the hot gas bypass tube.

As such, before the defrosting action is performed, the two-way valve is closed to allow the refrigerant to accumulate in the condenser, and then the three-way valve is switched to allow the refrigerant to flow to the hot gas bypass tube to perform the defrosting action. The likelihood of the condensation of the refrigerant in the hot gas state is reduced by reducing the amount of refrigerant flowing in the cooling loop during the defrosting action. Thus, a decrease in the defrosting capability can be suppressed.

Furthermore, the evaporator is provided with a temperature sensor, and the control device controls the three-way valve and the two-way valve according to the temperature measured by the temperature sensor to adjust the amount of the refrigerant during the defrosting action.

In this way, the control device can grasp whether the defrosting capability reduces based on the temperature measured by the temperature sensor. Thus, when it is detected that the amount of the refrigerant currently circulating in the cooling loop is too large or too small, the flow path of the refrigerant can be switched by switching the three-way valve and the two-way valve, to adjust the amount of the refrigerant circulating in the cooling loop.

Furthermore, an inner diameter of the hot gas bypass tube is larger than an inner diameter of a discharge pipe of the compressor, the refrigerant being discharged from the compressor through the discharge pipe.

As such, in the refrigerator in which the defrosting of the evaporator is performed in the hot gas defrosting manner, the pressure loss when the refrigerant flows in the hot gas bypass tube can be reduced, thereby suppressing the condensation of the refrigerant.

Furthermore, an inner diameter of the three-way valve is larger than an inner diameter of the discharge pipe of the compressor.

As such, in the refrigerator in which the defrosting of the evaporator is performed in the hot gas defrosting manner, the pressure loss when the refrigerant flows in the three-way valve can be reduced, thereby suppressing the condensation of the refrigerant.

Furthermore, the compressed refrigerant is sent to the condenser through a first connecting pipeline, and the first connecting pipeline is provided with the three-way valve and divided into a first sub-pipeline and a second sub-pipeline.

Furthermore, the condensed refrigerant is sent to the capillary tube through a second connecting pipeline, and the second connecting pipeline is provided with the two-way valve and divided into a third sub-pipeline and a fourth sub-pipeline.

Furthermore, when the control device detects that the refrigerant in the hot gas state flows to the evaporator but the temperature sensed by the evaporator temperature sensor is lower than a predetermined value upon the defrosting action, the control device controls so as to adjust the flow of the refrigerant flowing through the second flow path.

Furthermore, in the defrosting action, the three-way valve is in an open second state in which the refrigerant flows toward the hot gas bypass tube, and the two-way valve is in a closed state; by switching the three-way valve to the first state and operating the compressor, the refrigerant discharged from the compressor flows towards the condenser.

Furthermore, the evaporator and the fan are provided in the cooling chamber of the refrigerator, and the fan is controlled in conjunction with the operation of the compressor upon conventional operation; upon the conventional operation, if the compressor operates, the fan also operates; upon the defrosting action or upon switching to readiness for the defrosting action, the fan stops running; when the defrosting action transitions to the conventional operation, the fan starts to operate with a certain time delay after the compressor starts to operate.

Advantageous effects of the present invention are: the refrigerator according to the present invention is capable of more easily reducing the flow of the refrigerant flowing through the hot gas bypass tube without complicating the system and avoiding a decrease in the defrosting capacity.

DETAILED DESCRIPTION OF THE INVENTION

The present invention will be described hereunder in detail with reference to drawings and specific embodiments to make the objects, aspects and advantages of the present invention more apparent.

Figure 1:
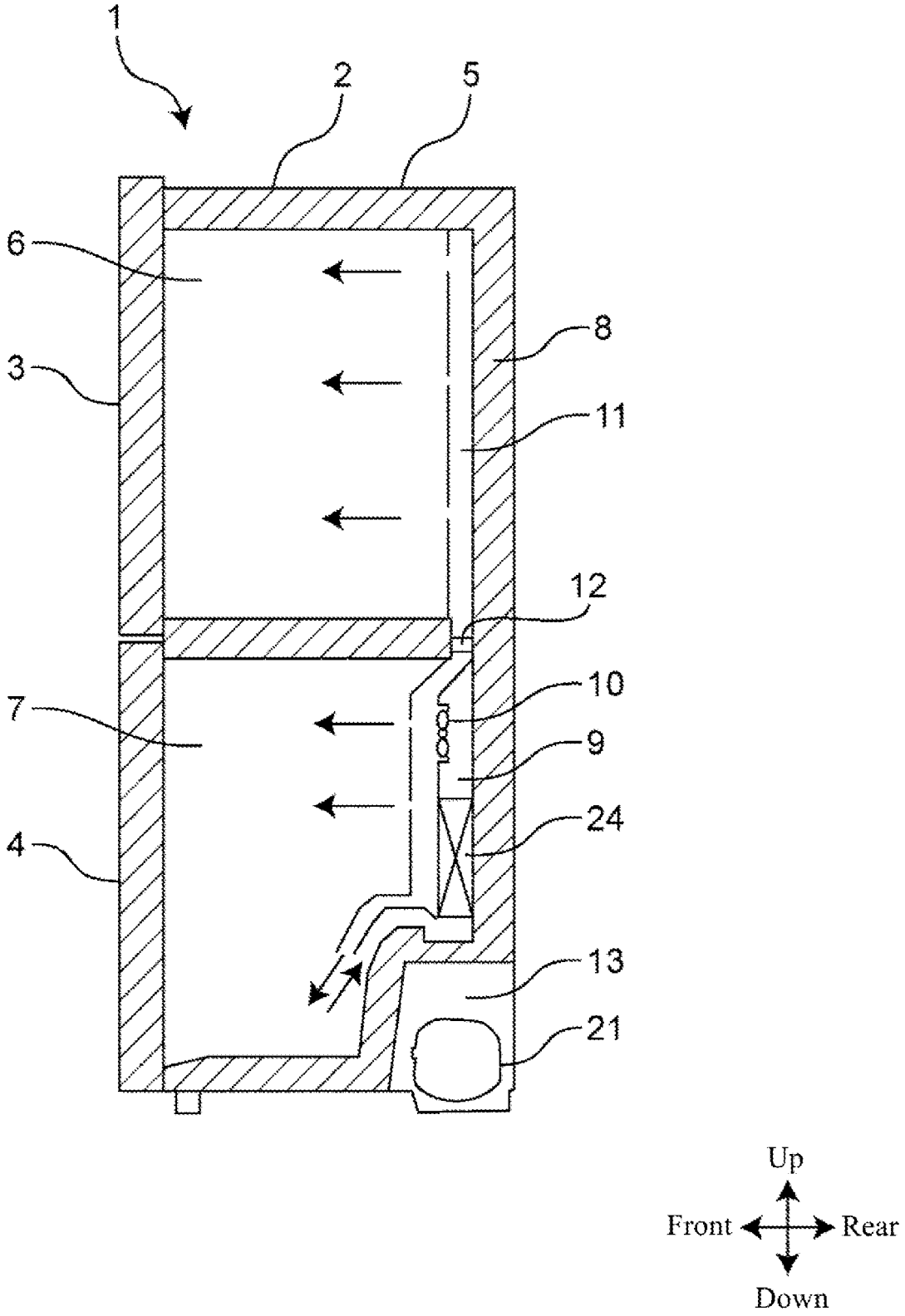
FIG. 1 is a side sectional view of a refrigerator according to the present invention.

An overview of a refrigerator 1 according to the present invention will be described with reference to FIG. 1. FIG. 1 is a side sectional view of the refrigerator according to the present invention. The refrigerator 1 has a refrigerator main body 2, a door body 3 and a drawer 4, wherein the door body 3 is rotatably disposed at a front side of the refrigerator main body 2 in a state that the refrigerator is placed on a horizontal plane, and the drawer 4 is movable in a front-rear direction. Upper and lower portions of the door body 3 are engaged with the refrigerator main body 2 via hinges provided on at least any side of left and right sides of the door body 3, and the door body 3 rotates about hinge shafts of the hinges. As described above, the refrigerator 1 of the present invention comprises two openable and closable members, namely, the door body 3 and the drawer 4, but the present invention is not limited thereto. For example, there can be more drawers, or all the openable and closable members can be constituted by the door body.

In addition, the refrigerator 1 comprises a housing 5 constituting an exterior of the refrigerator main body 2, and an upper liner 6 and a lower liner 7 constituting an interior receiving chamber. In the refrigerator 1 of the present embodiment, the upper liner 6 constitutes a refrigerating chamber, and the lower liner 7 constitutes a freezing chamber. When the door body 3 is opened, items can be placed in or taken out of the upper liner 6; when the drawer 4 is opened, items can be placed in or taken out of the lower liner 7. A receiving box (not shown) is mounted in the drawer 4 and moves integrally with the drawer 4. The receiving box is provided with an opening at an upper portion. When the items are received in the lower liner 7, they are configured and received through the opening into the receiving box. A foamed heat insulating material 8 is filled between the housing 5 and each of the liners 6 and 7, and each of the liners 6 and 7 is thermally insulated from the external of the refrigerator main body 2. In addition, the foamed heat insulating material 8 is also filled between the upper liner 6 and the lower liner 7.

As shown in FIG. 1, a cooling chamber 9 is formed in the rear of the interior of the lower liner 7, and an evaporator 24 as a cooling device is provided in the cooling chamber 9. As will be described later, the evaporator 24 forms part of a cooling loop 20 of the refrigerator. A fan 10 is provided in the cooling chamber 9, and the fan 10 blows cold air generated by the evaporator 24 to each of the liners 6, 7 via an air duct 11.

The air duct 11 is provided in a rear portion of the interior of each of the liners 6 and 7, and guides the cold air generated in the cooling chamber 9 to a front portion of each of the liners 6 and 7 via a vent provided in a front surface of the air duct 11. A damper 12 is provided in the air duct 11, and the damper 12 is configured to be controlled by a controller 41 to be described later to open and close. The controller 41 senses a temperature inside the refrigerator through a refrigerating chamber temperature sensor 14 (not shown) provided in the upper liner 6, and controls the opening and closing based on the temperature level. As such, the flow of the cold air flowing to the upper liner 6 (serving as the refrigerating chamber) can be adjusted so that the internal temperature of the upper liner 6 is kept constant in a temperature range different from the internal temperature of the lower liner 7 (serving as the freezing chamber).

A machine room 13 is disposed in a rear and lower portion of the refrigerator main body 2, and an evaporating dish (not shown) or the like is also disposed. The evaporating dish accumulates and evaporates discharged water. The discharged water results from the defrosting of the compressor 21, a condensing fan 13 that cools the compressor 21 and the condenser 22, and the evaporator 24.

Figure 2:
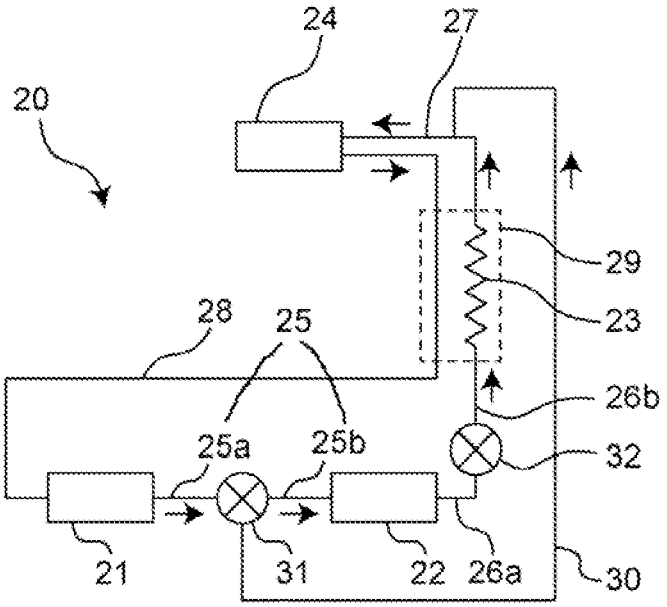
FIG. 2 is a circuit diagram of a cooling loop of the refrigerator according to the present invention.

FIG. 2 shows a cooling loop 20 of the refrigerator 1 according to the invention. The cooling loop 20 comprises a compressor 21, a condenser 22, a capillary tube 23 and an evaporator 24. As will be described later, the components of the cooling loop 20 are fluidly connected in the above-described order by conduits to form a first flow path through which a refrigerant circulates in the cooling loop 20. The arrows shown in FIG. 2 show a flow direction of the refrigerant. That is, in the cooling loop 20, for example, in the relationship between the compressor 21 and the evaporator 24 described later, the refrigerant flows from the evaporator 24 on the upstream side of the flow path to the compressor 21 on the downstream side of the flow path via a suction pipe 28.

The compressor 21 compresses the refrigerant in a gas state to make the refrigerant in a high-temperature and high-pressure state. The compressed refrigerant is sent to the condenser 22 through a first connecting pipeline 25. As stated later, the first connecting pipeline 25 is provided with a three-way valve 31 and is divided into a first sub-pipeline 25*a* and a second sub-pipeline 25*b*. The compressor 21 comprises an inverter, which, by changing a rotation speed, can adjust the amount of refrigerant discharged by the compressor per unit time, thereby controlling the cooling capacity of the cooling loop 20. The compressor 21 is electrically connected to a controller 41 to be described later, and controls the rotational speed by a signal transmitted from the controller 41. The condenser 22 discharges heat of the refrigerant compressed by the compressor 21 to condense the refrigerant. The condensed refrigerant is sent to the capillary tube 23 through a second connecting pipeline 26. As will be described later, the second connecting pipeline 26 is provided with a two-way valve 32 and is divided into a third sub-pipeline 26*a* and a fourth sub-pipeline 26*b*.

The capillary tube 23 lowers the pressure of the refrigerant condensed by the condenser 22 so that refrigerant expands and the temperature of the refrigerant falls accordingly. The expanded refrigerant is sent to the evaporator 24 via a pipeline 27. The evaporator 24 enables the refrigerant decompressed by the capillary tube 23 to evaporate and absorb heat. The refrigerant evaporating and being in a gas state is sent to the compressor 21 through the suction pipe 28 to be compressed again. In this way, the cooling loop 20 operates. In the present embodiment, the capillary tube 23 is connected to the condenser 22 and the evaporator 24 via a fourth sub-pipeline 26*b* and the pipeline 27, but the fourth sub-pipeline 26*b* and the pipeline 27 can also be disposed in the capillary tube 23.

The suction pipe 28 is disposed at least partially adjacent to the capillary tube 23 to enable heat exchange between the suction pipe 28 and the capillary tube 23, and the suction pipe 28 enables the refrigerant to flow from the evaporator 24 to the compressor 21. A region 29 surrounded by a dashed line in FIG. 2 shows an outline of the heat exchange section.

When the evaporator 24 operates to cool the inside of the refrigerator 1, the surrounding steam might frost. In order to defrost the evaporator 24, the refrigerator 1 of the present invention employs a hot gas defrost mode using the hot gas of the refrigerant compressed by the compressor 21. Thus, the cooling loop 20 comprises a hot gas bypass tube 30 connected to a first connecting pipeline 25 connecting the downstream compressor 21 with the upstream condenser 22. A three-way valve 31 is disposed at the connection location and can be switched so that the refrigerant sent from the compressor 21 through the first sub-pipeline 25*a* flows to either the condenser 22 (i.e., the second sub-pipeline 25*b*) or the hot-gas bypass pipe 30. Thus, it is possible to control to allow the refrigerant to flow to the condenser 22 to cool the evaporator 24 or allow the refrigerant to flow to the hot gas bypass tube 30 to defrost the evaporator 24. The hot gas bypass tube 30 is connected to a pipeline which is connected to the downstream capillary tube 23 and the upstream evaporator 24.

The hot gas bypass tube 30 forms a second flow path on which the refrigerant flows through the compressor 21-the first connecting pipeline 25-the hot gas bypass tube 30-the pipeline 27-the evaporator 24 path. The second flow path is different from the first flow path on which the refrigerant flows through the compressor 21-the first connecting pipeline 25-the condenser 23-the second connecting pipeline 26-the capillary tube 23-the pipeline 27-the evaporator 24 path.

The three-way valve 31 is connected to a controller 41 to be described later, and the switching of the flow path of the refrigerant is controlled by the controller 41 based on a predetermined condition. The controller 41 controls the three-way valve 31 so that the refrigerant, which is discharged from the compressor 21 via the first sub-pipeline 25*a*, flows to the condenser 22 (i.e., the second sub-pipeline 25*b*) in a conventional operation to be described later, and flows to the hot gas bypass tube 30 upon a defrosting operation to be described later.

In the present description, a state in which the refrigerator 1 is conventionally operated (i.e., a state in which the refrigerator 1 is operated such that the interior of the refrigerator is cooled, or the temperature in the interior of the refrigerator is maintained) is appropriately referred to as "a conventional operation". Further, a state in which the refrigerator 1 is operated such that the evaporator 24 is defrosted (i.e., a state in which the refrigerator is operated such that the three-way valve 31 is opened such that the refrigerant flows from the three-way valve 31 to the hot gas bypass tube 30 and the hot gas flows to the evaporator 24) is appropriately referred to as a "defrosting action".

The cooling loop 20 of the refrigerator 1 in the present embodiment comprises a two-way valve 32 in a second connecting pipeline 26, and the second connecting pipeline 26 fluidly connects the condenser 22 with the capillary tube 23. The two-way valve 32 is connected to the controller 41. The controller 41 controls the opening and closing of the two-way valve 32 according to the refrigerant discharged from the condenser 22. The flow of the refrigerant to the fourth sub-pipeline 26*b* can be shut off by closing the two-way valve 32.

Figure 3:
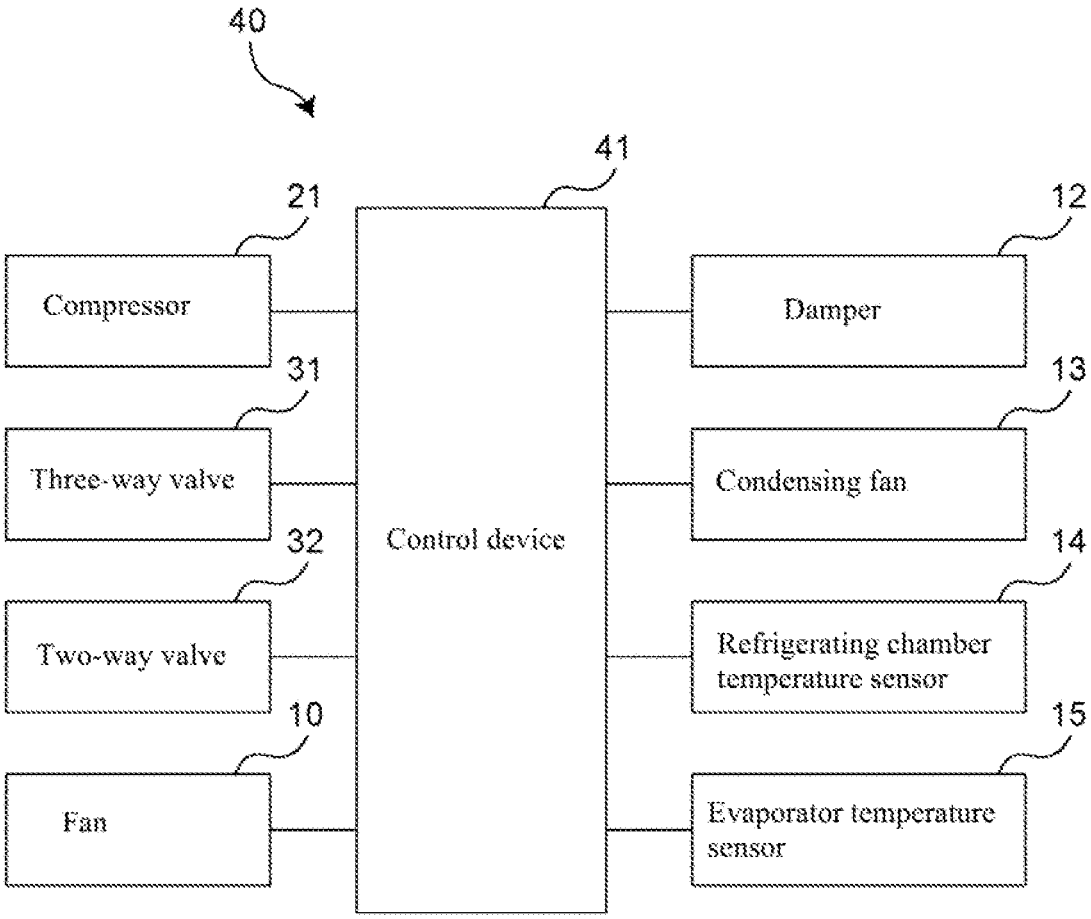
FIG. 3 is a block diagram of a control system of the refrigerator according to the present invention.

FIG. 3 is a block diagram of a control system 40 of the refrigerator 1 according to the present invention. The control system 40 of the refrigerator 1 in the present embodiment comprises a controller 41 that controls various devices. The controller 41 comprises a plurality of control units. For example, the controller 41 comprises a control portion (not shown) and a storage portion (not shown).

The control section comprises a general-purpose processor, such as a CPU or MPU, which performs a predetermined function by executing a program. For example, the control portion invokes and executes an arithmetic program or the like stored in the storage portion, thereby realizing various processes in the controller 41 and transmitting a signal to each component. The control portion is not limited to realizing the predetermined function by cooperation of hardware and software, and it can be a hardware circuit specially designed to achieve the predetermined function. That is, the control portion can be implemented by various processors such as a GPU, an FPGA, a DSP, an ASIC, etc. in addition to the CPU and the MPU. Such a control portion can be constituted by, for example, a signal processing circuit serving as a semiconductor integrated circuit.

The storage portion is a recording medium capable of recording various types of information. The storage portion is implemented by a memory such as a DRAM, a SRAM and a flash memory, an HDD, an SSD, other storage devices, or a suitable combination thereof. The storage portion can store, for example, a temperature obtained by the refrigerating chamber temperature sensor 14 and the evaporator temperature sensor 15, a pressure value obtained by the pressure sensor, and so on. In addition, the storage portion can store programs for controlling the components (the compressor 21, the three-way valve 31, the two-way valve 32, the fan 10, the damper 12, etc.) based on the temperature, pressure, etc. The storage portion can also store a control program related to the conventional operation and defrosting action described later. Each of the components can also transmit and receive information directly between the components by the control portion without via the storage portion.

As described above, the compressor 21, the three-way valve 31, and the two-way valve 32 are electrically connected to the controller 41. Further, the controller 41 is electrically connected to the fan 10, the damper 12, the condensing fan 13, the refrigerating chamber temperature sensor 14, the evaporator temperature sensor 15, etc. Other temperature sensors can also be mounted (e.g., the freezing chamber temperature sensor can be mounted in the lower liner 7 constituting the freezing chamber), and the temperature sensor can be electrically connected to the controller 41. The controller 41 controls to maintain the temperatures of the refrigerating chamber and the freezing chamber, etc. at a predetermined temperature based on the signal from the refrigerating chamber temperature sensor 14 and the like.

The controller 41 can start the defrosting action under any condition. For example, a defrost switch (not shown) can be provided in the refrigerator 1. The defrosting action is started when the controller 41 detects that the user has turned on the switch. Instead of the defrost switch, or in addition to the defrost switch, a timer can be provided. The defrosting action starts when a time period set by the user in the timer has elapsed. Further, an elapsed time detection function can be provided in the controller 41, and the defrosting action can start when the elapsed time starting from the previous defrosting action exceeds a predetermined time. A sensor capable of detecting the opening and closing of at least one of the door body 3 or the drawer 4 can also be provided, and configured to detect the number of times of opening and closing. The defrosting action starts when the number of times exceeds a predetermined threshold.

A decrease in the defrosting capacity of the defrosting action when the refrigerant flows to the hot gas bypass tube 30 can be avoided by providing the three-way valve 31 and the two-way valve 32 as in the cooling loop 20 of the refrigerator 1 in the present embodiment. An example of the operation of the cooling loop 20 will be described below.

Upon the conventional operation of the refrigerator 1, the three-way valve 31 is opened to allow the refrigerant to flow towards the condenser 22. Hereinafter, this state of the three-way valve 31 is also referred to as "a first state". Further, hereinafter, a state in which the three-way valve 31 is opened to allow the refrigerant to flow to the hot gas bypass tube 30 is also referred to as "a second state". The two-way valve 32 is configured to be opened and closed by the controller 41 according to the operation of the compressor 21. Therefore, upon the conventional operation, when the compressor 21 compresses and discharges the refrigerant, the two-way valve 32 is in the open state. In addition, in the present embodiment, the two-way valve 32 is in the closed state when the compressor 21 stops. However, the present invention is not limited to this, and the two-way valve can be maintained in the open state in a case where the compressor 21 stops during the conventional operation.

Upon transitioning the operation of the cooling loop 20 from the conventional operation state to the defrosting action, the controller 41 first maintains the three-way valve 31 in the first state while changing the two-way valve 32 to the closed state. Thus, the refrigerant does not flow downstream of the fourth sub-line **26*b*. In this state, the controller 41 operates the compressor 21 to discharge the refrigerant to the condenser 22. As a result, the refrigerant can be accumulated in the condenser 22 and the second sub-pipeline 25*b* and the third sub-pipeline 26*a* (hereinafter, it is stated that the refrigerant is accumulated in the condenser 22 for ease of depictions). The rotation speed of the compressor 21 can be adjusted to increase or decrease the discharge amount. For example, if the discharge amount from the compressor 21 is increased, the refrigerant can be accumulated to the condenser 22** faster, and further, more refrigerant can be accumulated.

After the refrigerant is accumulated in the condenser 22, the controller 41 switches the three-way valve 31 to the second state to perform the defrosting action. Accordingly, the refrigerant (hot gas) is discharged from the compressor 21 to the hot gas bypass tube 30. At this time, the two-way valve 32 maintains the closed state. The controller 41 can perform the above-described switching of the three-way valve 31 by detecting that, for example, refrigerant has accumulated in the condenser 22 for a predetermined time. Furthermore, the load of the compressor 21 can be detected by measuring the rotation speed and the current value of the motor included in the compressor 21 to perform the switching. A pressure sensor can be provided in the flow path from the compressor 21 to the condenser 22, in the condenser 22, or the like, and can be configured to detect the pressure of the coolant at the position. The switching can be performed when the pressure sensor detects that the pressure at the position becomes greater than a predetermined threshold value.

The amount of the refrigerant in the cooling loop 20 during the defrosting action can be reduced by controlling the three-way valve 31 and the two-way valve 32 as described above. The cooling loop 20 serves as the first flow path upon the conventional operation, namely, a flow path in which the refrigerant flows into the evaporator 24 through the condenser 22 and the capillary tube 23 after being discharged from the compressor 21, as stated above. Oppositely, the cooling loop 20 upon the defrosting action serves as the second flow path, namely, a flow path in which the refrigerant flows into the evaporator 24 through the hot gas bypass tube 30 after being discharged from the compressor 21, as stated above. As such, the second flow path has a smaller number of components through which the refrigerant passes than the first flow path. Furthermore, since the condenser 22 discharges heat of the refrigerant compressed by the compressor 21, it generally constitutes a long flow path. Therefore, the length of the entire flow path of the second flow path is shorter than that of the first flow path. Therefore, the amount of refrigerant can be excessive with respect to the length of the flow path.

If the amount of the refrigerant in the defrosting action is excessive, the refrigerant that becomes the hot gas is apt to condense into the liquid state (i.e., the return of the liquid of the hot gas is apt to occur). If the refrigerant becomes liquid and flows into the compressor 21, the reliability of the compressor 21 might decrease, for example, the performance might decrease, etc. In addition, the temperature of the suction pipe 28 might drop, resulting in dew condensation.

In addition, when the amount of the refrigerant in the pipeline through which the refrigerant flows increases and the refrigerant in a liquid state occurs in the pipeline, the space through which the refrigerant in a hot gas state can pass in the pipeline becomes narrow. As a result, an increase in the flow rate of the refrigerant and an increase in the pressure loss occur, and further, the refrigerant in the hot gas state is prone to condense into the liquid state.

However, like the cooling loop 20 of the refrigerator 1 in the present embodiment, the possibility of the condensation of the refrigerant in the hot gas state is reduced by reducing the amount of the refrigerant flowing in the cooling loop during the defrosting action before performing the defrosting action. Thus, a decrease in the defrosting capability can be suppressed.

In addition, in the cooling loop 20 of the refrigerator 1 of the present invention, an evaporator temperature sensor 15 is provided at the evaporator 24. The evaporator temperature sensor 15 is mounted, for example, at a portion where the refrigerant is discharged from the evaporator 24. The evaporator temperature sensor 15 detects the temperature of the evaporator 24 and transmits the detected temperature to the controller 41. Thus, the controller 41 can detect whether a predetermined defrosting capacity can be exhibited during the defrosting action.

If the temperature detected by the evaporator temperature sensor 15 during the defrosting action is lower than a predetermined value, defrosting of the evaporator 24 might not be sufficiently performed. In this case, it is believed that one of the reasons is that the defrosting capacity is lowered due to the condensation of the refrigerant due to the excess of the refrigerant as described above. Therefore, preferably, the amount of the refrigerant flowing through the second flow path in the defrosting action is reduced.

Therefore, when the controller 41 detects that the refrigerant in the hot gas state flows to the evaporator 24 but the temperature sensed by the evaporator temperature sensor 15 is lower than a predetermined value upon the defrosting action, the controller 41 controls so as to adjust the flow of the refrigerant flowing through the second flow path. Specifically, for example, the flow of the refrigerant can be adjusted by switching the three-way valve 31.

In the defrosting action, as described above, the three-way valve 31 is in the second state, and the two-way valve 32 is in the closed state. The refrigerant discharged from the compressor 21 is allowed to flow to the condenser 22 by switching the three-way valve 31 to the first state and operating the compressor. Since the two-way valve 32 is in a closed state, the refrigerant cannot flow towards the downstream of the third sub-pipeline 26*a* and accumulates in the condenser 22. Then, the flow of the refrigerant flowing through the second flow path can be reduced by switching the three-way valve 31 to the second state. In this way, the condensation of the refrigerant in the hot gas state in the pipeline can be suppressed, thereby suppressing the reduction of the defrosting capability.

Figure 4:
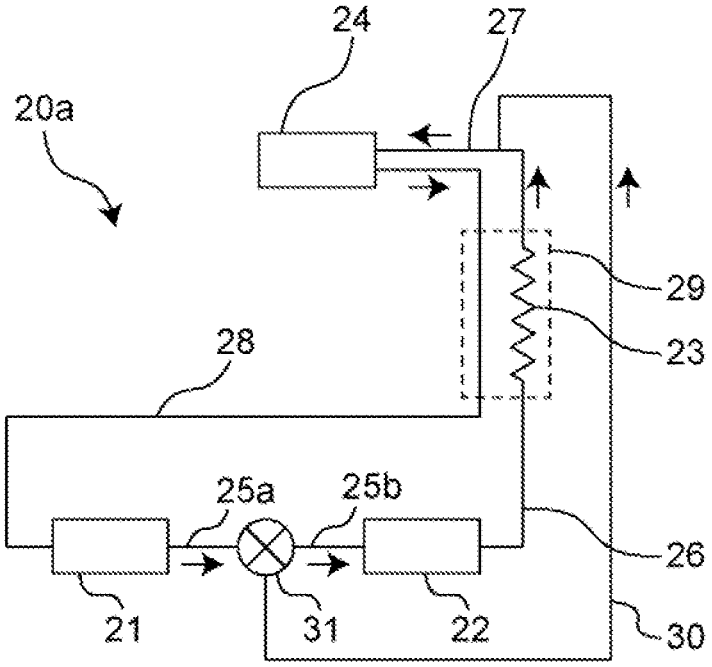
FIG. 4 is a circuit diagram of one example of a cooling loop conventionally used in the prior art.

The cooling loop 20*a* shown in FIG. 4 is an example of a simple cooling loop for a conventional refrigerator employing the manner of defrosting with hot gas. The same components of the cooling loop 20*a* as those of the cooling loop 20 are marked with the same reference numbers. It can be clearly seen from the comparison between FIG. 2 and FIG. 4 that the difference between the cooling loop 20*a* of the conventional refrigerator and the cooling loop 20 lies in not including the two-way valve 32. As stated above, the cooling loop 20 of refrigerator 1 in the present embodiment can reduce the flow of refrigerant through the second flow path by only adding the two-way valve 32 to the cooling loop 20*a* of the conventional refrigerator and increasing the control of the two-way valve 32. Therefore, it is easy to avoid the condensation of the refrigerant in the hot gas state in the pipeline during frosting action, thereby suppressing the decrease in the defrosting capability.

In addition, there may be other reasons for the decrease in defrosting capacity, in addition to excessive amount of the refrigerant. For example, thoughts are given to the case where an inner diameter 30*a* of the hot gas bypass tube 30 is smaller than an inner diameter 21*a* of a discharge pipe for discharging the refrigerant from the compressor 21. In this case, the flow rate of the refrigerant flowing in the pipeline increases, the pressure loss increases, and the refrigerant in the hot gas state is prone to condensation. Therefore, by setting the inner diameter 30*a* of the hot gas bypass tube 30 to be greater than the inner diameter 21*a* of the discharge pipe of the compressor 21, the pressure loss upon flow of the refrigerant can be reduced, thereby avoiding the refrigerant from condensing. In addition, the circuit volume of the cooling loop 20 used during defrosting, including the second flow path, can be increased by increasing the inner diameter 30*a* of the hot gas bypass tube 30.

In addition, the inner diameter of the smallest part in the space where the refrigerant inside the three-way valve 31 flows is taken as an opening diameter 31*a* (hereinafter appropriately referred to as the inner diameter 31*a* of the three-way valve 31). Thoughts are given to the fact that the magnitude of the opening diameter 31*a* also affects the reduction of the defrosting capability. When the inner diameter 31*a* of the three-way valve 31 is smaller than the inner diameter 21*a* of the discharge pipe for discharging the refrigerant from compressor 21, the flow rate of the refrigerant flowing through the three-way valve 31 increases, the pressure loss increases, and the refrigerant in the hot gas state is prone to condensation. Therefore, the pressure loss upon the flow of the refrigerant can be reduced by setting the inner diameter 31*a* of the three-way valve 31 to be greater than the inner diameter 21*a* of the discharge pipe of the compressor 21, thereby suppressing of condensation of the refrigerant.

Table 1 is an example of changes of the temperature T of the evaporator 24 caused by the defrosting action when the inner diameter 30*a* of the hot gas bypass tube 30 and the inner diameter 31*a* of the three-way valve 31 are changed as compared with the inner diameter 21*a* of the discharge pipe of the compressor 21. The temperature T is a temperature measured by a temperature sensor (not shown), which is mounted at a lower portion of the evaporator 24 for measurement. The lower portion is a portion in evaporator 24 where the temperature is difficult to rise.

TABLE 1

| Inner diameter 30a(mm) | Φ4 | | | Φ6 |
|---|---|---|---|---|
| Inner diameter 31a(mm) | Φ2 | Φ4 | Φ6 | Φ6 |
| Temperature T(° C.) | −0.4 | 5.4 | 5.8 | 7.2 |

In the above example, a test is performed in a case where the discharge pipe of the compressor 21 with the inner diameter 21*a* being Φ4.76 (i.e., 4.76 mm) is used, and an ambient temperature is 16° C. In this example, the hot gas bypass tube 30 with the inner diameter 30*a* being Φ4 and Φ6 is used. In addition, the three-way valve 31 with the inner diameter 31*a* being Φ2, Φ4 and Φ6 is used.

As shown in Table 1, when the inner diameter 30*a* of the hot gas bypass tube 30 is Φ4, if the inner diameter 31*a* of the three-way valve 31 is changed to Φ2, Φ4 and Φ6, the temperature T measured by the temperature sensor mounted at the evaporator 24 upon completion of the defrosting is −0.4° C., 5.4° C., and 5.8° C., respectively. As such, as known from Table 1, the pressure loss upon the flow of the refrigerant can be reduced by making the inner diameter 31*a* of the three-way valve 31 greater than the inner diameter 21*a* of the discharge pipe of the compressor 21, thereby avoiding a decrease in the defrosting capacity.

In addition, when the inner diameter 31*a* of the three-way valve 31 is Φ6, if the inner diameter 30*a* of the hot gas bypass tube 30 is changed to Φ4 and Φ6, the temperature measured by the temperature sensor mounted at the evaporator 24 upon completion of the defrosting is 5.8° C. and 7.2° C., respectively. As such, as known from Table 1, the pressure loss upon the flow of the refrigerant can be reduced by making the inner diameter 30*a* of the hot gas bypass tube 30 greater than the inner diameter 21*a* of the discharge pipe of the compressor 21, thereby avoiding a decrease in the defrosting capacity.

Figure 5:
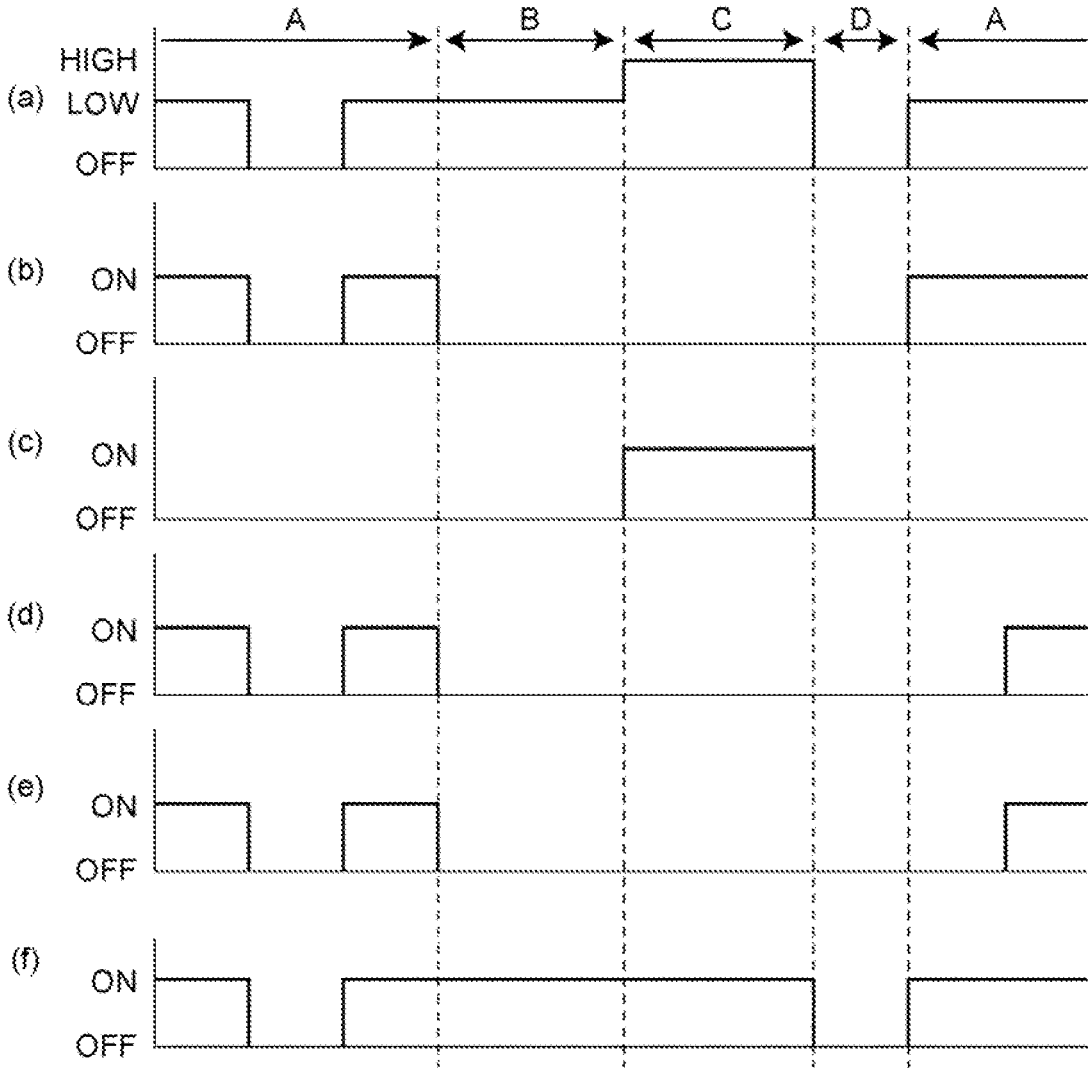
FIG. 5 is a timing diagram of a control system of the refrigerator according to the present invention.

FIG. 5 is a timing diagram of the operation of the cooling loop 20 and other cooling devices of the present invention. In FIG. 5, (a), (b), (c), (d), (e), and (f) respectively illustrate the timing of the operation of the compressor 21, two-way valve 32, three-way valve 31, fan 10, damper 12, and condensing fan. The controller 41 can be controlled by conveying control signals as described below to each device.

FIG. 5(*a*) shows the rotation speed of the compressor 21. "OFF" means that compressor 21 stops working. "LOW" means that the rotation speed of the motor of the compressor 21 is low. "HIGH" means that the rotation speed of the motor of the compressor 21 is high.

In FIG. 5(*b*), "ON" means that the two-way valve 32 is open. In addition, "OFF" means that the two-way valve 32 is closed.

In FIG. 5(*c*), "ON" means that the three-way valve 31 is in the second state. In addition, "OFF" means that the three-way valve 31 is in the first state.

In FIGS. 5(*d*) and (*f*), "ON" respectively means that respective fans are running. In addition, "OFF" means that the respective fans stop running.

In FIG. 5(*e*), "ON" means opening the damper 12 to allow cold air from the cooling chamber 9 to be blown above the air duct 11. In addition, "OFF" means that damper 12 is closed.

Period A in FIG. 5 is a period during which conventional operation is conducted. During the conventional operation, the compressor 21 and the two-way valve 32 operate in linkage. When the compressor 21 operates, the two-way valve 32 is in the open state. In addition, when the compressor 21 stops, the two-way valve 32 is in the closed state. Compared to this, the three-way valve 31 is in the first state in each case.

Period B is a preparatory stage before the defrosting action, and is a period during which the refrigerant is accumulated in the condenser 32 (i.e., a pump down is temporarily performed). During the period B, the compressor 21 continues to operate, but the two-way valve 32 is switched to the closed state. In addition, the three-way valve 31 is in the first state as in conventional operation. In the timing diagram shown in FIG. 5, the compressor 21 operates at the same rotational speed as in the conventional operation, but can be configured to operate at a rotational speed greater than or less than the above rotational speed.

Period C is a period during which the defrosting action is performed. The compressor 21 operates in the same manner as in the periods A and B. In addition; the two-way valve 32 is in the closed state. The three-way valve 31 is switched to the second state and allows the refrigerant to flow towards the hot gas bypass tube 30. In the timing diagram shown in FIG. 5, the rotational speed of the compressor 21 increases as compared with the rotational speed upon conventional operation. However, the rotational speed of the compressor 21 can be equal to or smaller than the rotational speed upon conventional operation.

Period D is a certain period after the completion of the defrosting action. After completion of the defrosting action, the compressor 21 stops running, and the three-way valve 31 is switched to the first state. After a certain period of time has elapsed, the compressor 21 is operated again for the conventional operation, and furthermore, the two-way valve 32 is switched to the open state. At this time, since the high-temperature refrigerant is caused to flow in the evaporator 24 in the defrosting action, the temperature of the evaporator 24 is higher than a usual temperature. Therefore, in order to lower the temperature of the evaporator 24, after a certain period has passed, the fan 10 or the like is operated, and the conventional operation is started.

The fan 10 is substantially controlled in conjunction with the operation of the compressor 21 upon conventional operation. Upon the conventional operation, if the compressor 21 operates, the fan 10 also operates. Upon the defrosting action or upon switching to readiness for the defrosting action, the fan 10 stops running. In addition, when the defrosting action transitions to the conventional operation, the evaporator 24 heated in the defrosting action needs to be cooled after the compressor 21 starts to operate, so that the fan 10 starts to operate with a certain time delay after the compressor 21 operates.

The opening or closing of the damper 12 is controlled substantially in conjunction with the operation of the fan 10. In addition, although not illustrated, even if the fan 10 is in operation, the damper 12 can be closed so as to maintain the temperature in the upper liner 6 constant according to the temperature detected by the refrigerating chamber temperature sensor mounted in the upper liner 6 which serves as the refrigerating chamber.

The condensing fan 13 operates in conjunction with the compressor 21.

As described above, the controller 41 controls the compressor 21, the two-way valve 32, and the three-way valve 31, thereby making it possible to avoid a decrease in the defrosting capacity by the cooling loop of the refrigerator 1 according to the present embodiment.

The present invention is not limited to the illustrated embodiments, and various modifications and design changes can be made without departing from the spirit of the present invention.

INDUSTRIAL AVAILABILITY

As described above, according to the present invention, a refrigerator 1 can be provided. The refrigerator is capable of easily reducing the flow of the refrigerant flowing through the hot gas bypass tube without including a complicated system, avoiding a decrease in the defrosting capacity. Therefore, such a refrigerator can be preferably utilized in the industrial field of refrigerators.

The above embodiments are only used to illustrate the technical solutions of the present invention not to limit the present invention. Although the present invention is described in detail with reference to preferred embodiments, those having ordinary skill in the art should appreciate that modifications or equivalent substitutions may be made to the technical solution of the present invention, without departing from the spirit and scope of the technical solution of the present invention.

What is claimed is:

1. A refrigerator, wherein the refrigerator comprises: a cooling loop having a first flow path connected in order of a compressor, a condenser, a capillary tube, and an evaporator and configured to circulate a refrigerant, the compressor compressing the refrigerant sent from the evaporator, the condenser condensing the refrigerant sent from the compressor, the capillary tube expanding the refrigerant sent from the condenser, and the evaporator evaporating the refrigerant sent from the capillary tube;

the cooling loop comprising:

a hot gas bypass tube configured to form a second flow path in which the refrigerant compressed by the compressor flows from the compressor to the evaporator;

a three-way valve provided in the first flow path between the compressor and the condenser and connected to the hot gas bypass tube; and a two-way valve provided in the first flow path between the condenser and the capillary tube;

the three-way valve is capable of enabling the refrigerant discharged from the compressor to flow into the condenser or the hot gas bypass tube;

the two-way valve is capable of shutting off the flow of the refrigerant discharged from the condenser by closing;

wherein the refrigerator has a controller that switches the cooling loop to a conventional operation of cooling the evaporator and a defrosting action of defrosting the evaporator, upon transitioning the operation of the cooling loop from the conventional operation state to the defrosting action, the controller first maintains the three-way valve in a first state while changing the two-way valve to a closed state, the refrigerant does not flow downstream of the fourth sub-line, in this state, the controller operates the compressor to discharge the refrigerant to the condenser, after the refrigerant is accumulated in the condenser, the controller switches the three-way valve to a second state to perform the defrosting action.

2. The refrigerator according to claim 1, wherein controller is capable of controlling the three-way valve to allow the fluid to flow to which one of the condenser and the hot gas bypass tube, and also is capable of controlling the opening and closing of the two-way valve, the controller is controlled in the following manner in case of switching from the conventional operation to the defrosting action: the three-way valve enables the refrigerant to flow to the condenser and closes the two-way valve, thereby discharging the refrigerant to the condenser through the compressor, and then the three-way valve enables the refrigerant to flow to the hot gas bypass tube.

3. The refrigerator according to claim 2, wherein the evaporator is provided with a temperature sensor, and the controller controls the three-way valve and the two-way valve according to the temperature measured by the temperature sensor to adjust the amount of the refrigerant during the defrosting action.

4. The refrigerator according to claim 3, wherein an inner diameter of the hot gas bypass tube is larger than an inner diameter of a discharge pipe of the compressor, the refrigerant being discharged from the compressor through the discharge pipe.

5. The refrigerator according to claim 2, wherein an inner diameter of the three-way valve is larger than an inner diameter of the discharge pipe of the compressor.

6. The refrigerator according to claim 3, wherein the compressed refrigerant is sent to the condenser through a first connecting pipeline, and the first connecting pipeline is provided with the three-way valve and divided into a first sub-pipeline and a second sub-pipeline.

7. The refrigerator according to claim 6, wherein the condensed refrigerant is sent to the capillary tube through a second connecting pipeline, and the second connecting pipeline is provided with the two-way valve and divided into a third sub-pipeline and a fourth sub-pipeline.

8. The refrigerator according to claim 3, wherein when the controller detects that the refrigerant in the hot gas state flows to the evaporator but the temperature sensed by the evaporator temperature sensor is lower than a predetermined value upon the defrosting action, the controller controls so as to adjust the flow of the refrigerant flowing through the second flow path.

9. The refrigerator according to claim 3, wherein in the defrosting action, the three-way valve is in an open second state in which the refrigerant flows toward the hot gas bypass tube, and the two-way valve is in a closed state; by switching the three-way valve to the first state and operating the compressor, the refrigerant discharged from the compressor flows towards the condenser.

10. The refrigerator according to claim 3, wherein the evaporator and a fan are provided in the cooling chamber of the refrigerator, and the fan is controlled in conjunction with the operation of the compressor upon conventional operation; upon the conventional operation, if the compressor operates, the fan also operates; upon the defrosting action or upon switching to readiness for the defrosting action, the fan stops running; when the defrosting action transitions to the conventional operation, the fan starts to operate with a certain time delay after the compressor starts to operate.

* * * * *